US011905945B2

(12) United States Patent
Chou et al.

(10) Patent No.: US 11,905,945 B2
(45) **Date of Patent: *Feb. 20, 2024**

(54) PISTON OF AIR COMPRESSOR

(71) Applicants: Wen-San Chou, Tainan (TW); Cheng-Hsien Chou, Tainan (TW)

(72) Inventors: Wen-San Chou, Tainan (TW); Cheng-Hsien Chou, Tainan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/709,033

(22) Filed: Mar. 30, 2022

(65) Prior Publication Data

US 2022/0333591 A1 Oct. 20, 2022

(30) Foreign Application Priority Data

Apr. 14, 2021 (TW) ..... 110113460

(51) Int. Cl.
*F04B 53/12* (2006.01)
*F04B 39/14* (2006.01)
(Continued)

(52) U.S. Cl.
CPC ..... *F04B 53/123* (2013.01); *F04B 39/0016* (2013.01); *F04B 39/1073* (2013.01);
(Continued)

(58) Field of Classification Search
CPC .. F04B 35/04; F04B 39/0016; F04B 39/1033; F04B 39/1037; F04B 39/14;
(Continued)

(56) References Cited

U.S. PATENT DOCUMENTS 2,000,883 A 5/1935 Cullen et al.
2004/0146418 A1* 7/2004 Kang ..... F04B 39/0016 417/549
(Continued)

FOREIGN PATENT DOCUMENTS

CN 101240785 8/2008
CN 101240785 A * 8/2008
(Continued)

OTHER PUBLICATIONS

"Search Report of Europe Counterpart Application", dated Aug. 25, 2022, p. 1-p. 7.
(Continued)

*Primary Examiner* — Alexander B Comley
(74) *Attorney, Agent, or Firm* — JCIPRNET

(57) ABSTRACT

A piston of an air compressor, the air compressor including the piston actuated by a motor to move upward and downward in a cylinder. The piston contains a head accommodating an air stop sheet which has a first bending section being a boundary line of an acting area and a positioning zone of the air stop sheet. The acting zone has a noncircular spacing groove configured to separate an external portion and a circular portion, a neck, and a second bending section, such that an axial line between the circular portion and the external portion is the second bending section at an obtuse angle less than 180 degrees, and the second bending section is defined between a bottom of the circular portion and a top of the external portion at an acute angle θ2.

4 Claims, 7 Drawing Sheets

(51) Int. Cl.

| | |
|---|---|
| ***F04B 39/00*** | (2006.01) |
| ***F04B 39/10*** | (2006.01) |
| ***F04B 53/10*** | (2006.01) |
| ***F04B 35/04*** | (2006.01) |

(52) U.S. Cl.
CPC ..... *F04B 39/14* (2013.01); *F04B 53/1037* (2013.01); *F04B 53/1085* (2013.01); *F04B 35/04* (2013.01)

(58) Field of Classification Search
CPC ..... F04B 53/123; F04B 53/128; F04B 39/1073–1086; F04B 39/1093; F04B 53/1037; F04B 53/1085
See application file for complete search history.

(56) References Cited

U.S. PATENT DOCUMENTS

2007/0264140 A1* 11/2007 Chou ..... F04B 39/0016 417/415
2007/0264141 A1 11/2007 Chou
2011/0076164 A1* 3/2011 Chou ..... F04B 53/12 417/550
2018/0223822 A1 8/2018 Lee et al.

FOREIGN PATENT DOCUMENTS

| | | |
|---|---|---|
| DE | 102007053750 | 5/2009 |
| JP | H0791376 | 4/1995 |
| JP | H07103138 | 4/1995 |
| JP | H11230042 | 8/1999 |
| JP | 2009115044 | 5/2009 |
| JP | 2009115045 | 5/2009 |
| JP | 3237748 | 6/2022 |
| KR | 20050043489 | 5/2005 |
| KR | 100880303 | 1/2009 |

OTHER PUBLICATIONS

"Office Action of Japan Counterpart Application", dated May 9, 2023, p. 1-p. 7.
"Office Action of Korea Counterpart Application", dated Nov. 21, 2023, p. 1-p. 6.

* cited by examiner

PISTON OF AIR COMPRESSOR

FIELD OF THE INVENTION

The present invention relates to an air compressor, and more particularly to a piston of the air compressor which moves upward and downward in a cylinder of the air compressor.

BACKGROUND OF THE INVENTION

A conventional air compressor contains: a motor, a piston driven by the motor to move reciprocately in a cylinder, such that airs are compressed to produce compressed airs, and the compressed airs are delivered to a storage holder from the cylinder, thereafter the compressed airs are inflated into a deflated object via an output tube of the storage holder via a delivery hose connected with the output tube. The piston includes a conduit communicating with a head thereof, an air stop sheet covered on the conduit of a plane of a top of the piston. When the air compressor stops, the air stop sheet closes the conduit of the head of the piston. After the air compressor operates again, airtightness produces among an airtight ring and the air stop sheet of the head of the piston and the air stop sheet, so the compressed airs cannot be discharged out of the cylinder completely. After starting the air compressor once more, the piston hit the compressed airs in the cylinder to increase loading and electric currents of the air compressor, thus reducing a service life of the air compressor.

The present invention has arisen to mitigate and/or obviate the afore-described disadvantages.

SUMMARY OF THE INVENTION

The primary aspect of the present invention is to provide a piston of an air compressor by which the air channel of the piston is communicated smoothly so that a pressure of the cylinder balances with atmosphere, and the piston is not stopped by an additional resistance (i.e. a back-pressure resistance) in the upward moving stroke after the air compressor is operated again, and the piston moves in the cylinder smoothly to enhance using safety and service life and to inflate the compressed airs into the deflated object easily.

To obtain above-mentioned aspect, a piston of an air compressor provided by the present invention contains: a head accommodating an air stop sheet, the air stop sheet includes a first bending section which is a boundary line of an acting area and a positioning zone of the air stop sheet so that a positive surface of the air stop sheet forms an obtuse angle less than 180 degrees, and a back surface of the acting zone of the air stop sheet backing the top of the cylinder turns on relative to a plane of a top of the head at an open angle θ1, thus producing an air flowing space.

The acting zone has a noncircular spacing groove configured to separate an external portion and a circular portion, a neck formed on a connection of the external portion and the circular portion, a second bending section formed on the neck in a mechanical working manner, and the second bending section and the circular portion extend upward, such that an axial line between the circular portion and the external portion is the second bending section at an obtuse angle less than 180 degrees, and the second bending section is defined between a bottom of the circular portion and a top of the external portion at an acute angle θ2.

The head has the two separated bolts, and the positioning zone of the air stop sheet has two spaced orifices connecting with the two separated bolts of the head, thus fixing the air stop sheet on the head. The acting zone of the air stop sheet has a passing orifice, and the head has a hook configured to engage with the passing orifice. A length (or a height) of the hook is determined based on the output power of the air compressor to match with a moving path of the air stop sheet.

When the piston moves in the upward moving stroke, the acting zone of the air stop sheet contacts with the plane of the top of the head so that the air stop sheet closes the conduit. When the piston moves in the downward moving stroke, the air stop sheet is pushed by external airs to expand but is limited by a horizontal post of the hook, thus avoiding the using fatigue of the air stop sheet. When the piston stops, the acting zone of the air stop sheet opens on relative to the plane of the top of the head, and the passing orifice of the air stop sheet is stopped by the horizontal post of the hook.

The first bending section of the air stop sheet has at least one collapsible guide line which is a first collapsible guide line and a second collapsible guide line, such that the air compressor operates smoothly.

DETAILED DESCRIPTION OF THE PREFERRED EMBODIMENTS

Figure 1:
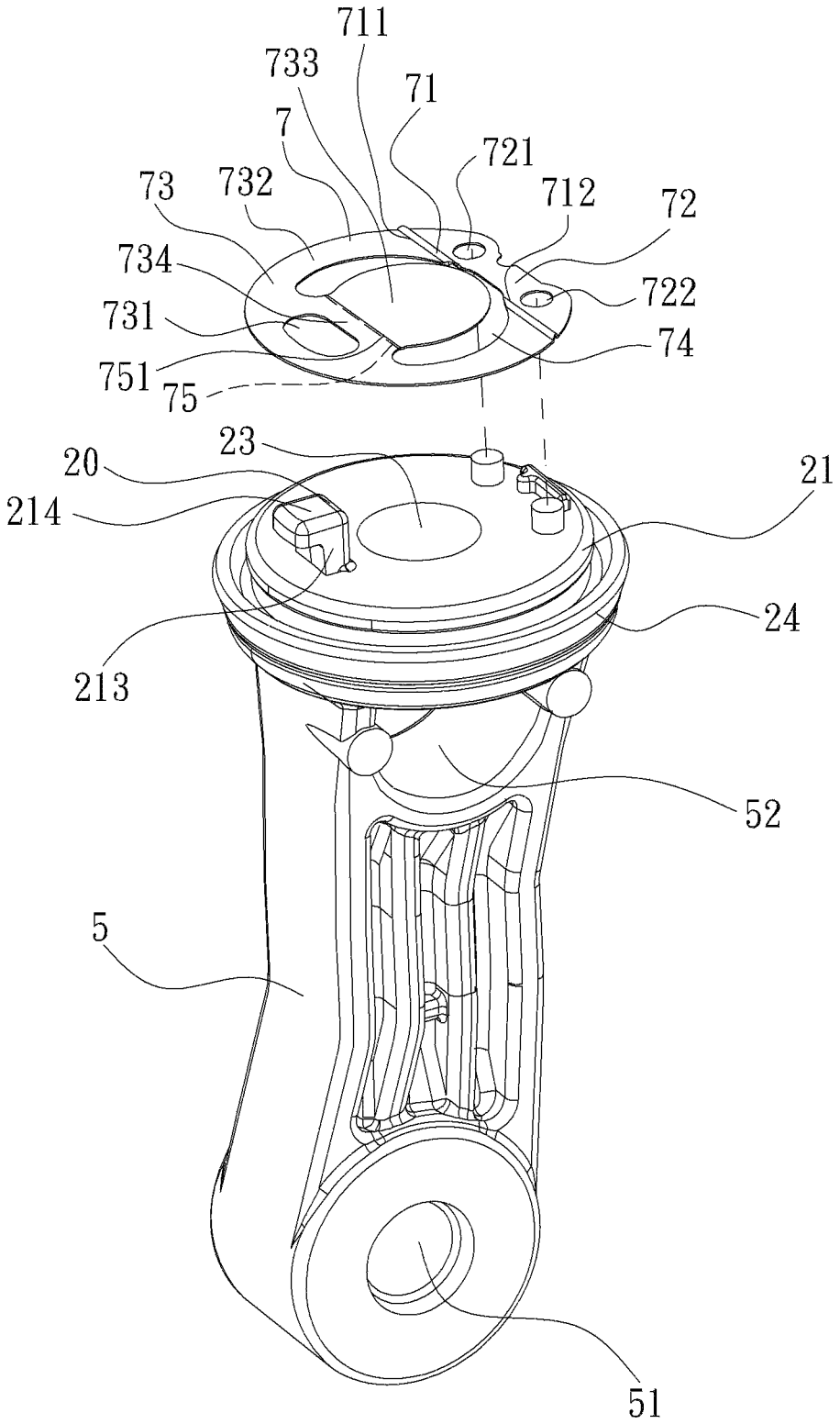
FIG. 1 is a perspective view showing the exploded components of a piston of an air compressor according to a preferred embodiment of the present invention.
Figure 2:
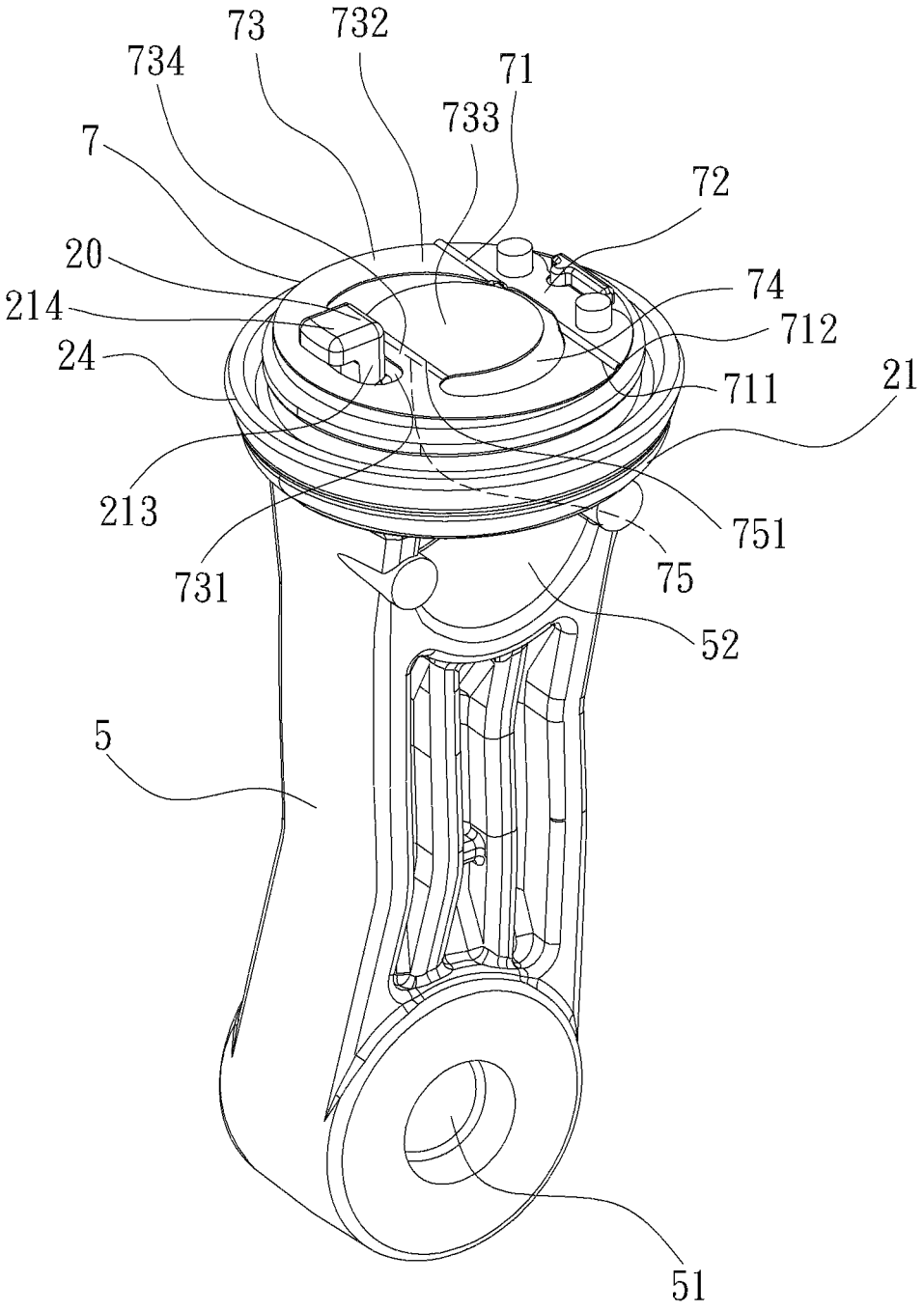
FIG. 2 is a perspective view showing the assembly of the piston of the air compressor according to the preferred embodiment of the present invention.
Figure 3:
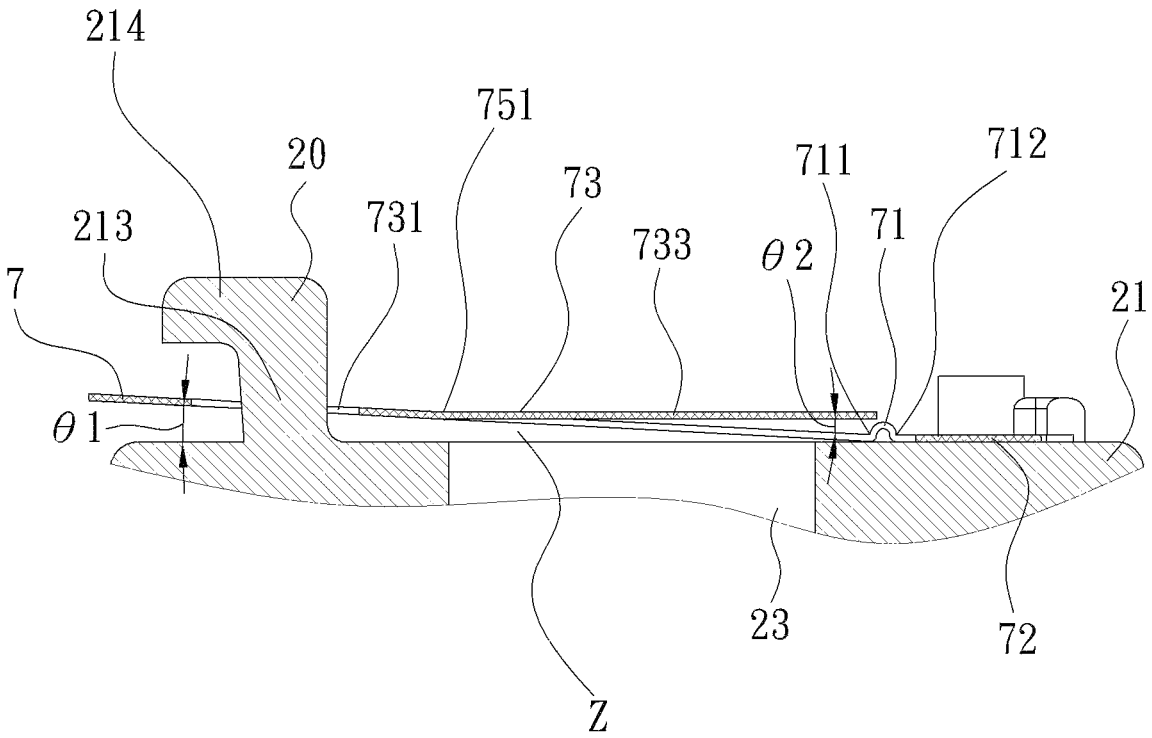
FIG. 3 is an amplified cross sectional view showing the operation of the piston of the air compressor according to the preferred embodiment of the present invention.
Figure 4:
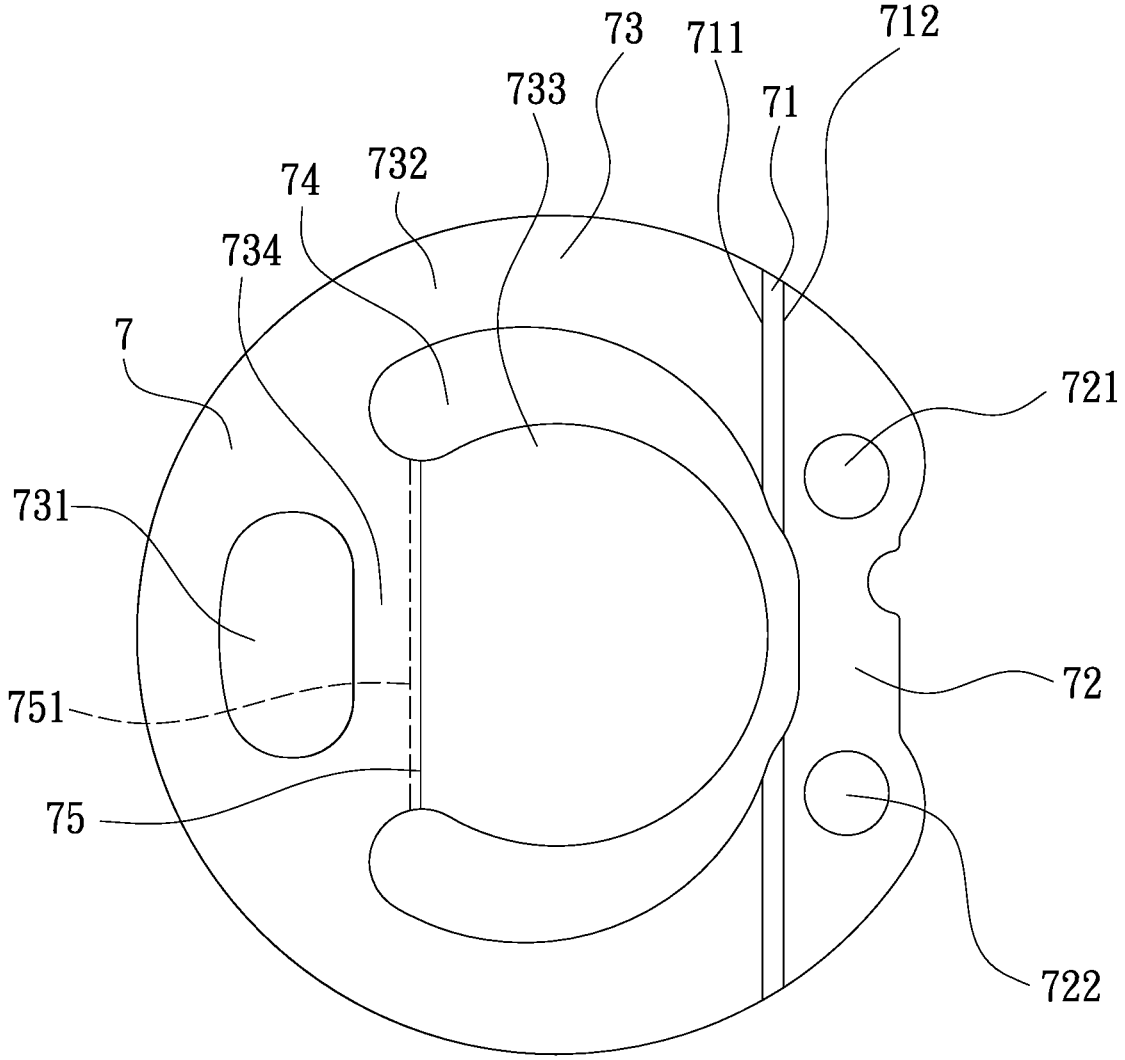
FIG. 4 is a top plan view showing the assembly of an air stop sheet of the piston of the air compressor according to the preferred embodiment of the present invention.
Figure 5:
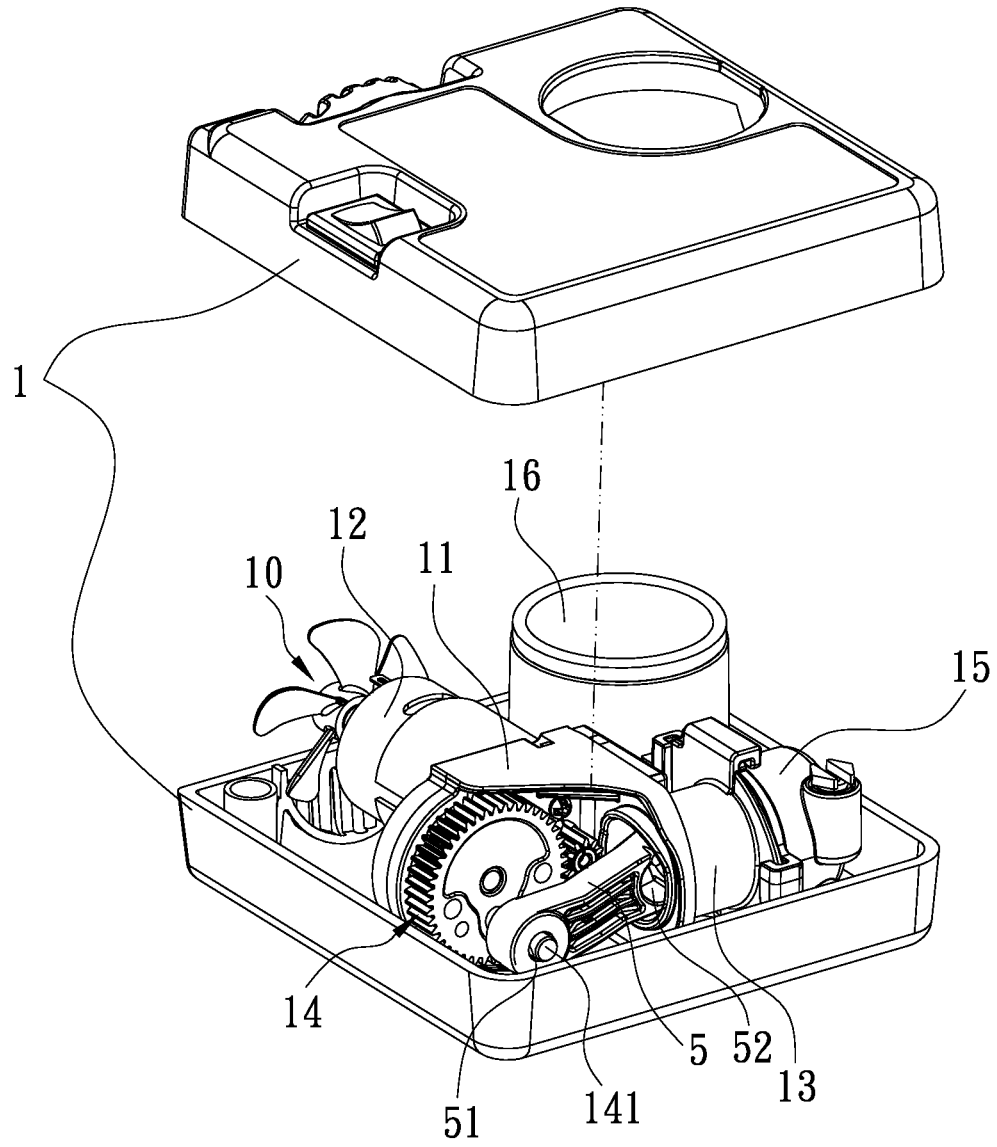
FIG. 5 is a perspective view showing the exploded components of an air compressor according to the preferred embodiment of the present invention.
Figure 6:
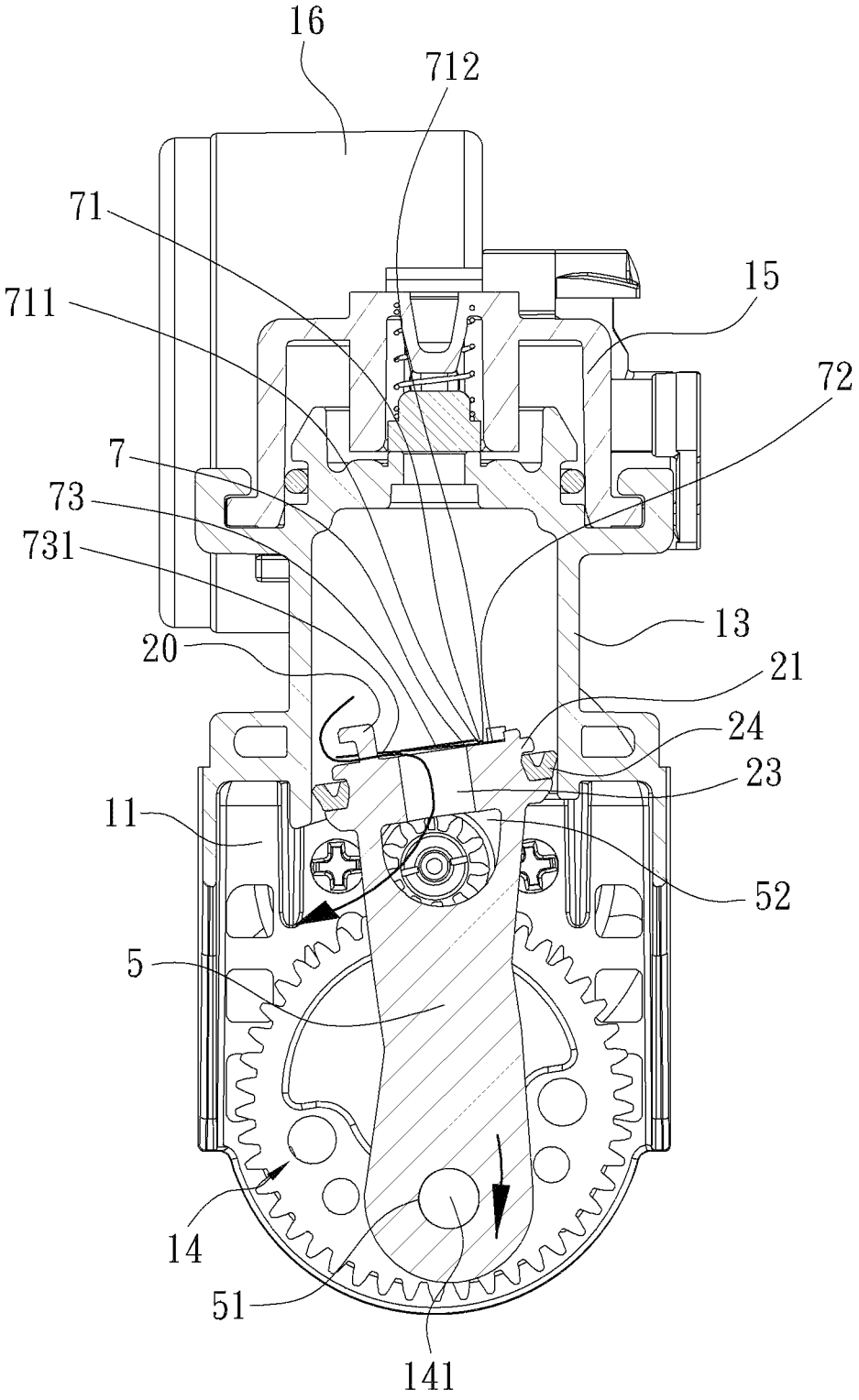
FIG. 6 is a cross sectional view showing the operation of the piston of the air compressor according to the preferred embodiment of the present invention.
Figure 7:
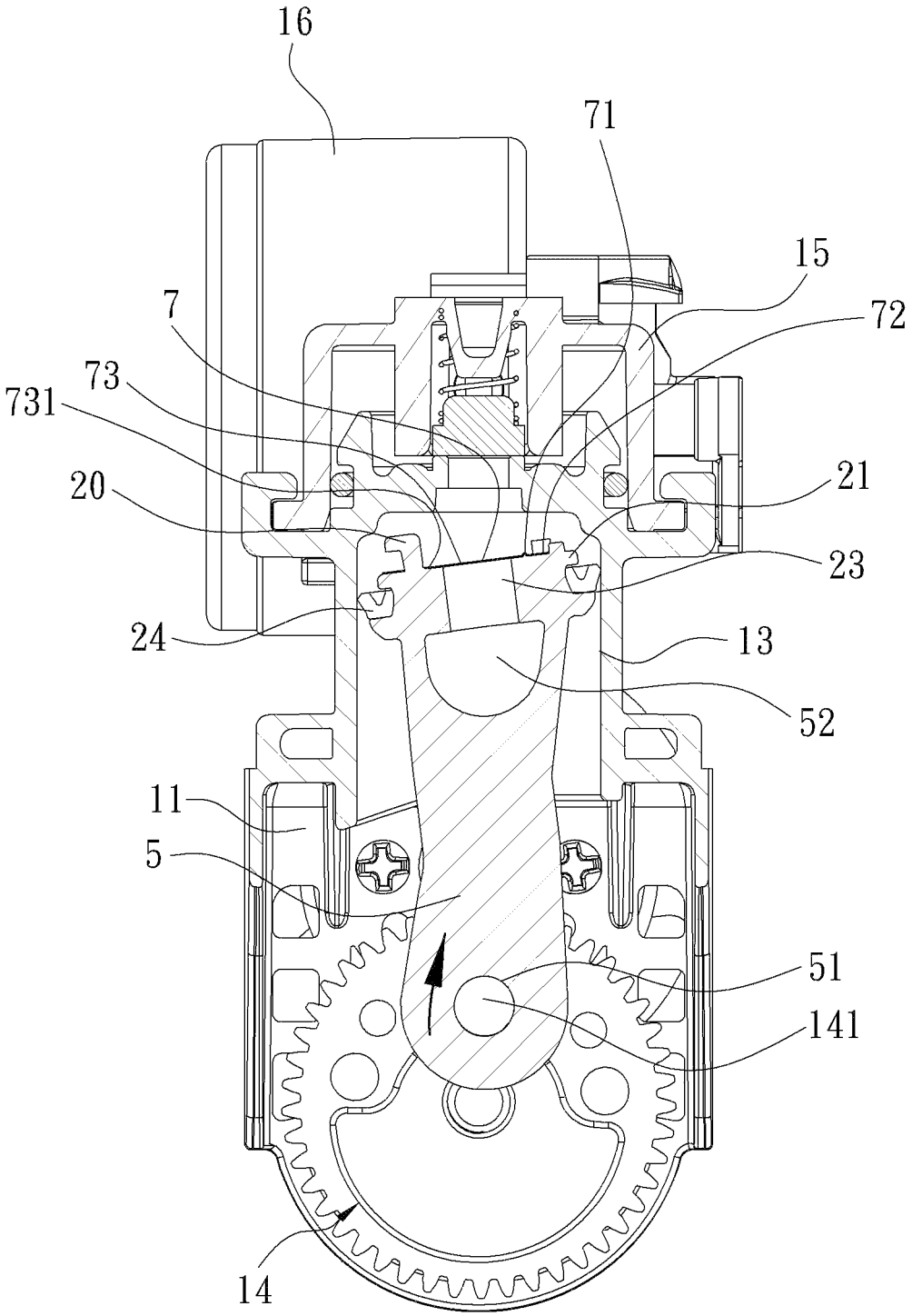
FIG. 7 is another cross sectional view showing the operation of the piston of the air compressor according to the preferred embodiment of the present invention.

With reference to FIG. 5, an air compressor 10 according to a preferred embodiment of the present invention is received in an accommodation chamber, a box 1 or other a work place. In this embodiment, as shown in FIG. 5, the box 1 receives the air compressor 10 configured to inflate airs or to connect with a sealant supply (not shown), thus inflating the airs and supplying sealant. The air compressor 10 includes a substrate 11 configured to fix a motor 12, a cylinder 13 connected on the substrate 11, a transmission mechanism 14 mounted on the substrate 11 and connected with a piston. Referring to FIGS. 1 to 7, the piston includes a head 21, a seal ring 24 mounted around an outer wall of the head 21 and configured to close the piston and the cylinder 13 when the air compressor operates, and an air channel 23 communicating with the head 21, wherein a piston rod 5 extends downward from the head 21, and the piston rod 5 includes a circular orifice 51 defined on a bottom thereof and rotatably connected with a crankshaft 141 of the transmission mechanism 14, an air conduit 52 formed on a top of the piston rod 5 and communicating with the air channel 23 of the head 21. When an output shaft of the motor 12 actuates the crankshaft 141 of the transmission mechanism 14 to rotate and the piston to move upward and downward in the cylinder 13, the airs are compressed to produce compressed airs, and the compressed airs flow into a storage holder 15 so as to be supplied into a pressure gauge 16 via a delivery pipe, thus displaying a pressure value. Thereafter, the compressed airs are inflated into a deflated object (not shown) via an air hose. Alternatively, the compressed airs and sealant are supplied to a broken tire (not shown) via the air hose or a valve. Since it is well-known art, further remarks are omitted.

The piston of the air compressor 10 includes the head 21, and a piston rod 51 connected with the head 21, and the head 21 of the piston of the air compressor 10 accommodates an air stop sheet 7, and the air stop sheet 7 includes a first bending section 71 formed in any one of a tooth shape, an arch shape, an inverted U shape, and a step shape in a mechanical working manner, wherein the first bending section 71 of the air stop sheet 7 has at least one collapsible guide line, wherein a first collapsible guide line 711 and a second collapsible guide line 712 are formed on the first bending section 71 to match with an output power of the air compressor, and the first bending section 71 has a positioning zone 72 arranged on a first end of the first bending section 71 of the air stop sheet 7, and an acting zone 73 arranged on a second end of the first bending section 71 of the air stop sheet 7, wherein the acting zone 73 has a noncircular spacing groove 74 configured to separate an external portion 732 and a circular portion 733, a neck 734 formed on a connection of the external portion 732 and the circular portion 733, a second bending section 75 formed on the neck 734 in a mechanical working manner, and the second bending section 75 and the circular portion 733 extend upward, such that an axial line between the circular portion 733 and the external portion 732 is the second bending section 75 at an obtuse angle less than 180 degrees. In addition, a first bending collapsible guide lines 751 of the second bending section 75 is defined between a bottom of the circular portion 733 and a top of the external portion 732 at an acute angle θ2, such that when an external pressure acts to the air stop sheet 7, the first collapsible guide line 711 and the second collapsible guide line 712 of the first bending section 71 and the first collapsible guide line (track) 751 of the second bending section 75 open or close the air stop sheet 7, wherein a positioning zone 72 is formed on a side of the second collapsible guide line 712 and is located on the head 21 so that the head 21 has the two separated bolts, and the positioning zone 72 of the air stop sheet 7 has two spaced orifices 721, 722 connecting with the two separated bolts of the head 21, thus fixing the air stop sheet 7 on the head 21. The first collapsible guide line 711 of the air stop sheet 7 has an acting zone 73 opposite to the positioning zone 72 of the air stop sheet 7, the acting zone 73 has the external portion 732, the circular portion 733, and the neck 734 formed on the connection of the external portion 732 and the circular portion 733, wherein the second bending section 75 is formed on the neck 734 formed in a mechanical working manner and has the first bending collapsible guide lines 751, wherein the circular portion 733 extends upward at the acute angle θ2 so as to close the air channel 23, when the piston moves in an upward moving stroke.

The first bending section 71 is a boundary line of the acting area 73 and the positioning zone 72 of the air stop sheet 7 so that a positive surface of the air stop sheet 7 (i.e. a top of the air stop sheet 7 facing the cylinder 13 in the upward moving stroke) forms an obtuse angle less than 180 degrees, and a back surface of the acting zone 73 of the air stop sheet 7 backing the top of the cylinder 13 opens relative to a plane of a top of the head 21 at an open angle θ1, thus producing an air flowing space Z. Thereby, when the piston of the air compressor 10 stops, the circular portion 733 of the acting zone 73 of the air stop sheet 7 opens relative to the air channel 23 and the conduit 52, and the air channel 23 of the piston is communicated smoothly so that a pressure of the cylinder 13 balances with atmosphere. The piston is not stopped by an additional resistance (i.e. a back-pressure resistance) in the upward moving stroke after the air compressor 10 is operated again, and the piston moves in the cylinder 13 smoothly to enhance using safety and service life and to inflate the compressed airs into the deflated object easily. The external portion 732 of the acting zone 73 of the air stop sheet 7 has a passing orifice 731, and the head 21 has a hook 20 configured to engage with the passing orifice 731, wherein when the piston moves in the upward moving stroke, the acting zone 73 of the air stop sheet 7 contacts with the plane of the top of the head 21 so that the air stop sheet 7 closes the conduit 52; when the piston moves in the downward moving stroke, the air stop sheet 7 is pushed by external airs to expand but is limited by a horizontal post 214 of the hook 20, thus avoiding the using fatigue of the air stop sheet 7. When the piston stops, the acting zone 73 of the air stop sheet 7 turns on relative to the plane of the top of the head 21, and the passing orifice 731 of the air stop sheet 7 is stopped by the horizontal post 214 of the hook 20. Furthermore, the hook 20 has a vertical post 213 configured to turn on/off, expand, and retract the air stop sheet 7, so a length (or a height) of the vertical post 213 is determined based on the output power of the air compressor to match with a moving path of the air stop sheet 7, and the horizontal post 214 is configured to adjust a height of the air stop sheet 7.

Thereby, the air stop sheet 7 includes the first bending section 71 on which the first collapsible guide line 711 and the second collapsible guide line 712 are formed so that the acting zone 73 of the air stop sheet 7 opens relative to the plane of the top of the head 21 at the open angle θ1, and the second bending section 75 is defined between the bottom of the circular portion 733 and the top of the external portion 732 at the acute angle θ2, hence the air channel 23 of the piston is communicated smoothly so that the pressure of the cylinder 13 balances with atmosphere. The piston is not stopped by the additional resistance (i.e. the back-pressure resistance) in the upward moving stroke after the air compressor 10 is opened again, and the piston moves in the cylinder 13 smoothly to enhance the using safety and the service life and to inflate the compressed airs into the deflated object easily. Preferably, the air stop sheet 7 includes the first bending section 71 and the second bending section 75 so as to be turned on/off, expanded, and retracted smoothly, thus enhancing the using life.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A piston of an air compressor, the piston being actuated by a motor to move upward and downward in a cylinder;

wherein the piston of the air compressor includes a head accommodating an air stop sheet, the air stop sheet includes a first bending section which is a boundary line of an acting zone and a positioning zone of the air stop sheet so that an obtuse angle less than 180 degrees is formed between the acting zone and the positioning zone of the air stop sheet on a top surface of the air stop sheet, and an open angle θ1 is formed between a bottom surface of the acting zone of the air stop sheet and a top surface of the head of the piston, thus producing an air flowing space;

wherein the acting zone has a noncircular spacing groove configured to separate an external portion and a circular portion, a neck formed on a connection of the external portion and the circular portion, and a second bending section formed on the neck in a mechanical working manner, wherein the circular portion is configured to bend upward, such that an obtuse angle less than 180 degrees is formed between the circular portion and the external portion with respect to the second bending section, and wherein an acute angle θ2 is formed between the first bending section and the circular portion, wherein when an entirety of the air compressor is completely not in operation, the open angle θ1 formed between the acting zone of the air stop sheet and the head of the piston and the acute angle θ2 formed between the first bending section and the circular portion allow an airflow to flow through the air flowing space.

2. The piston of an air compressor as claimed in claim 1, wherein the positioning zone is arranged on a first end of the first bending section of the air stop sheet, and the acting zone is arranged on a second end of the first bending section of the air stop sheet.

3. The piston of an air compressor as claimed in claim 1, wherein the head has two separated bolts, and the positioning zone of the air stop sheet has two spaced orifices connecting with the two separated bolts of the head, thus fixing the air stop sheet on the head; wherein the acting zone of the air stop sheet has a passing orifice, and the head has a hook configured to engage with the passing orifice.

4. The piston of an air compressor as claimed in claim 3, wherein the hook has a vertical post and a horizontal post, wherein a height of the vertical post is determined based on an output power of the air compressor, such that the height of the vertical post is greater than a height of a moving path of the air stop sheet, and wherein the horizontal post is configured to limit the height of the moving path of the air stop sheet.

* * * * *